US008110097B2

(12) United States Patent
Arai

(10) Patent No.: US 8,110,097 B2
(45) Date of Patent: Feb. 7, 2012

(54) CIRCULATING WATER WASHING SYSTEM TOILET

(75) Inventor: Masashi Arai, Suita (JP)

(73) Assignee: Toya Kogyo Kabushiki Kaisha, Suita-shi (JP)

( * ) Notice: Subject to any disclaimer, the term of this patent is extended or adjusted under 35 U.S.C. 154(b) by 405 days.

(21) Appl. No.: 12/456,609

(22) Filed: Jun. 19, 2009

(65) Prior Publication Data

US 2010/0163474 A1 Jul. 1, 2010

(30) Foreign Application Priority Data

Jun. 20, 2008 (JP) ..... 2008-162036

(51) Int. Cl.
*C02F 1/00* (2006.01)

(52) U.S. Cl. ..... 210/167.1; 210/194; 210/196; 210/241

(58) Field of Classification Search ..... 210/167.1, 210/194, 196, 241
See application file for complete search history.

(56) References Cited

U.S. PATENT DOCUMENTS

| | | | | | |
|---|---|---|---|---|---|
| 3,891,554 | A * | 6/1975 | Cooper et al. | 210/173 |
| 3,915,857 | A * | 10/1975 | Olson | 210/668 |
| 4,210,528 | A * | 7/1980 | Coviello et al. | 210/605 |
| 4,359,789 | A * | 11/1982 | Roberts | 4/300 |
| 5,254,253 | A * | 10/1993 | Behmann | 210/607 |
| 5,256,378 | A * | 10/1993 | Elston | 435/290.2 |
| 5,258,121 | A * | 11/1993 | Jordan et al. | 210/605 |
| 6,383,369 | B2 * | 5/2002 | Elston | 210/86 |

FOREIGN PATENT DOCUMENTS

| | | |
|---|---|---|
| JP | 2002-119988 | 4/2002 |
| JP | 2003-117575 | 4/2003 |
| JP | 2004-209380 | 7/2004 |

* cited by examiner

*Primary Examiner* — Chester Barry
(74) *Attorney, Agent, or Firm* — Jordan and Hamburg LLP

(57) ABSTRACT

A system in which human waste in toilet water is decomposed and the treated water is circulated as wash water includes a toilet bowl body portion, a soil water storage tank configured to store the soil water discharged from a toilet bowl temporarily, a pump configured to pump up and deliver the soil water in the soil water storage tank, a reaction treatment tower containing filter elements as a microorganism carrier and performing a biological treatment by dispersing the soil water fed from the pump from an upper portion of the tower to bring the same into contact with the filter element, a water storage tank under the reaction treatment tower and configured to receive and store water passed through the reaction treatment tower, and a pump configured to pump up the water in the water storage tank and deliver the same as the wash water.

15 Claims, 11 Drawing Sheets

CIRCULATING WATER WASHING SYSTEM TOILET

BACKGROUND OF THE INVENTION

1. Field of the Invention

The present invention relates mainly to a toilet used in an interior of a room, and a circulating water system toilet in which soil water containing human wastes after having washed a toilet bowl is clarified and is used as wash water.

2. Description of Related Art

In the related art, many of toilets put for use in an interior of a room for persons in need of nursing care, for example, are not of a water washing system, but includes a tank for storing human wastes and has a structure in which eliminated human wastes are stored in the tank. Therefore, there are problems such as generation of unpleasant odor, being insanitation, deterioration of the environment such as the room, and giving the persons a sense of discomfort. Therefore, cleaning of the tank and disposal of the human wastes are necessary every time after elimination, and there is also a risk of secondary contamination after the waste disposal using chemical agents.

In recent years, as temporary lavatories used in sightseeing areas, event spots, or construction sites, especially in areas where reservation of wash water, or waste disposal of treated water is difficult, there is proposed a circulating water washing system toilet in which soil water is subjected to a clarification treatment by an aeration process which aerates the soil water containing the human wastes and decomposes organic matters by a metabolic action of microorganism, a trickling filter process which disperses the soil water on filter elements in a reaction chamber and decomposes the organic matter via a biological treatment, or a combination thereof and is reused as wash water (for example, JP-A-2002-119988 and Japanese Patent No. 3766792).

The toilet of the circulating water washing system needs no treatment of human wastes, uses only a small amount of water, and allows users to use comfortably without the unpleasant odor or a hygienic problem. However, since an apparatus for a decomposition treatment of the human waste is relatively large, it is not suitable for putting for use in the interior of the room.

SUMMARY OF THE INVENTION

In order to solve the above-described problems, it is an object of the invention to provide a circulating water washing system toilet configured to decompose soil water containing human wastes efficiently by a relatively small-sized clarification treatment apparatus, and allow treated water to be reused as wash water and be suitable as a toilet to be put for use in the interior of a room.

In order to solve the above-described problem, a first aspect of the invention is a circulating water washing system toilet configured to clarify soil water containing human wastes after having washed a toilet bowl and reuse the same as wash water, including a clarification treatment apparatus configured to decompose the soil water discharged from the toilet bowl independently from a toilet bowl main body portion, the clarification treatment apparatus including a soil water storage tank configured to temporarily store the soil water, a first pump configured to pump up and deliver the soil water in the soil water storage tank, a reaction treatment tower having a filter element as a microorganism carrier configured to perform a biological treatment while dispersing the soil water delivered by the first pump on the filter element and filtering the same, a water storage tank configured to receive and store water passing through the reaction treatment tower, and a second pump configured to pump up and deliver water in the water storage tank as the wash water.

According to the circulating water washing system toilet, the soil water containing the human wastes having washed in the interior of the toilet bowl after elimination is stored once in the soil water storage tank, is pumped up by an activation of the first pump, then is delivered to an upper portion of the reaction treatment tower, and is dispersed onto the filter element as the microorganism carrier in the reaction treatment tower. Solid component in the soil water is filtered out by the filter element while the dispersed soil water runs gradually downward along the filter element, and water content running along the filter element which carries microorganism is brought into an evaporation reaction and passes therethrough while decomposing the organic components, so that the water after treatment flows into the water storage tank provided in a lower portion of the reaction treatment tower. The solid component adhesively remaining on the filter element, whose organic matter being decomposed by a metabolic action of the microorganism or the biological treatment by the microorganism, disappears. The treated water stored in the water storage tank is pumped up by the second pump and delivered, and is used as the wash water. For example, when a wash water tank is provided in the toilet bowl main body portion, the treated water is delivered to and stored in the tank, and is used as the wash water. Therefore, little soil water before treatment remains in the soil water storage tank, so that generation of unpleasant odor is restrained, and hygienic usage without giving the user a sense of discomfort is achieved.

In the toilet as described above, preferably, the reaction treatment tower includes a plurality of guide cylinders formed into a funnel shape of a truncated cone with a large-diameter side oriented upward and combined by being stacked one on top of another so as to place a lower opening on a small-diameter side of the upper guide cylinder inside an upper opening on the large-diameter side of the lower guide cylinder at a distance from each other, and the filter elements having natural wood chips as the microorganism carrier filled and stored in the interior thereof. Accordingly, with the reservation of the distance between the respective guide cylinders, air permeability which is required for the evaporation reaction is desirably ensured, and the air permeability promotes the action of the microorganism retained in the filter elements formed of the natural wood chips to achieve an efficient decomposition treatment of the organic matter by the biological treatment. Therefore, a large-scale drive such as stirring is not necessary in the reaction treatment tower, and reduction of treatment time required for the decomposition and the evaporation treatments in the reaction treatment tower is achieved.

Preferably, a water delivery pipe from the first pump is drawn into an interior of the guide cylinder on an topmost layer, and a water dispersing apparatus is provided at an port end portion of the water delivery pipe for dispersing the delivered soil water onto the filter elements. Accordingly, the soil water delivered through the water delivery pipe is dispersed on the entire part of the filter elements.

Preferably, the water dispersing apparatus includes a water dispersing pipe member rotatably connected to the port end portion of the downwardly bent water delivery pipe, the water dispersing pipe member including nozzle members projecting radially outward from different positions thereof in terms of the circumferential direction thereof, the nozzle member having a nozzle port on a lower surface thereof, the water dispersing pipe member being connected to a handle for a rotating operation provided out of the tower via a rotation transmitter, and the directions of projection of the nozzle members are changeable by the rotating operation of the handle. Accordingly, the positions of the nozzle members projecting from the water dispersing pipe member is changeable and adjustable arbitrarily by the rotating operation of the handle at every water dispersing operation after the usage of the toilet, so that the soil water discharged from the nozzle port is dispersed over the entire filter elements, whereby the entire filter elements is effectively and evenly utilized for a filtering action.

In the toilet described above, preferably, the first pump is activated when the quantity of the soil water in the soil water storage tank reaches and exceeds a certain quantity and pumps up and delivers the soil water. Accordingly, when the quantity of the soil water flowing into the soil water tank every time a flushing action is performed after the elimination reaches and exceeds the certain quantity, the pump is immediately activated to pump up the soil water in the soil water storage tank and deliver the same to the reaction treatment tower, where the decomposition treatment is performed. Therefore, the soil water is treated every time after the elimination in the toilet with little storage of the soil water in the soil water storage tank.

Preferably, the first pump includes a stirring device configured to break a solid component in the soil water in the vicinity of a suction port. Accordingly, the solid component in the soil water, that is, waste material is crushed to allow the pump to pump it up, so as to be delivered to the reaction treatment tower without occurrence of clogging of the waste material.

In the toilet described above, the soil water storage tank preferably includes a screen configured to remove foreign substances arranged on the incoming side of the soil water from the toilet bowl. Accordingly, removal of the foreign substance which cannot be decomposed by the biological treatment is achieved.

Preferably, the first pump includes a cylindrical casing provided in the soil water storage tank so as to extend vertically downward from a ceiling portion of the soil water storage tank to a position in the vicinity of a bottom portion thereof and opened at a lower end thereof as the suction port, a rotating shaft connected rotatably by a drive unit installed in the cylindrical casing at the ceiling portion, a helical blade for pumping-up operation provided on the rotating shaft on the lower side in the cylindrical casing, and a soil water delivery pipe connected to a discharge port formed at part of the cylindrical casing on the upper side and configured to allow delivery of water to the reaction treatment tower. In particular, by setting the lower end opening of the cylindrical casing, which serves as the suction port, in the vicinity of the bottom portion of the soil water storage tank, treatment with little soil water remained in the soil water storage tank is achieved, so that generation of unpleasant odor is restrained.

With the provision of the stirring member configured to crush the solid component sucked from the lower end opening of the cylindrical casing at a lower end portion of the rotating shaft of the first pump, stirring is achieved simultaneously with the sucking action of the pump, so that the solid component in the soil water sucked by the pump is efficiently crushed.

In the toilet described above, preferably, the toilet bowl main body portion and the clarification treatment apparatus are installed on a base with casters so as to be movable, thereby being movable easily to a desired position in the room for use.

As described thus far, the circulating water washing system toilet in the invention is able not only to wash off the toilet bowl after the elimination, but also to trap the solid component in the soil water by pumping up soil water containing the human wastes having used for washing the toilet bowls from the soil water storage tank by the pump, delivering the same to the reaction treatment tower, dispersing the same onto the filter elements as the microorganism carriers to allow the same to pass therethrough while coming in contact thereto, and at the same time, and to perform a biological treatment with the microorganism to decompose and treat the organic matter progressively, whereby the treated water after the clarification treatment is allowed to be reused as the wash water. Therefore, generation of the unpleasant odor caused by the soil water containing the human wastes left untreated in the soil water storage tank for a long time is restrained, so that the hygienic usage without giving the user a sense of discomfort is achieved. In addition, a small quantity of water is used therefor, which is economically advantageous.

DESCRIPTION OF THE PREFERRED EMBODIMENTS

Figure 1:
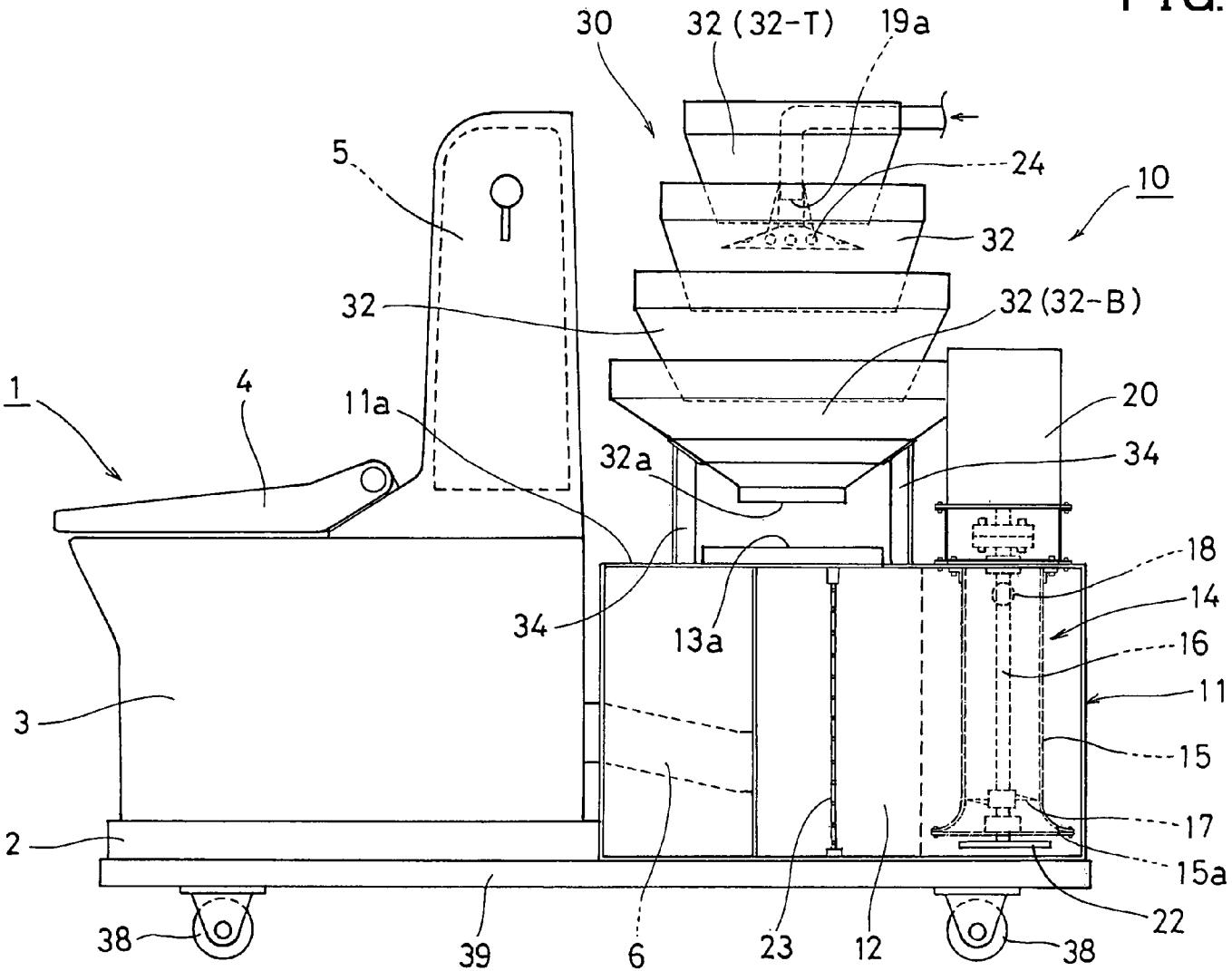
FIG. 1 is a schematic side view of a circulating water washing system toilet according to a first embodiment of the invention.
Figure 2:
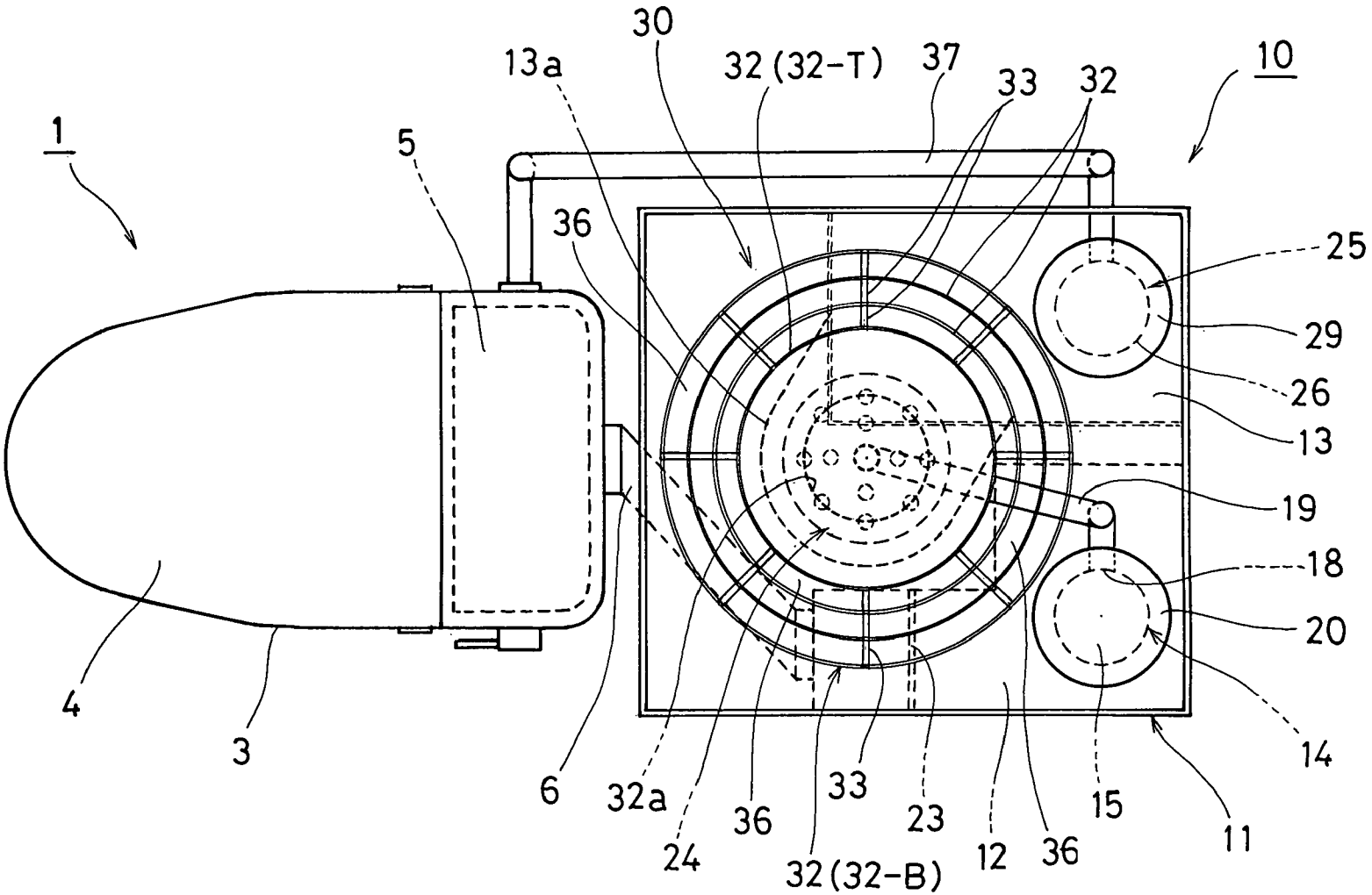
FIG. 2 is a schematic plan view of the toilet in FIG. 1.
Figure 3:
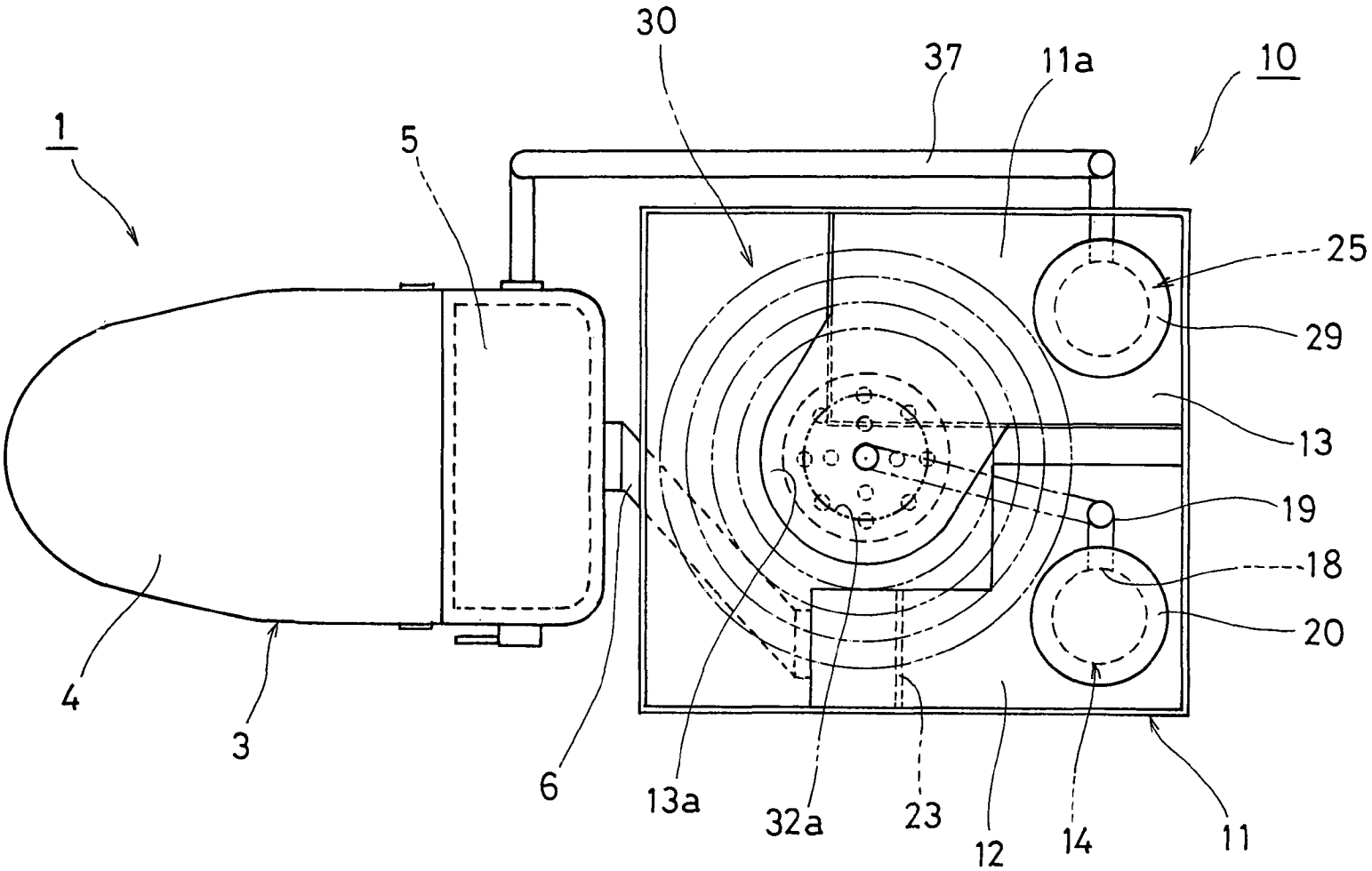
FIG. 3 is a schematic plan view of the toilet in FIG. 1 from which a reaction treatment tower is omitted.

Embodiments of the invention will be described on the basis of examples shown in the drawings.

In a first embodiment shown in FIG. 1 to FIG. 6, reference numeral 1 designates a toilet bowl main body portion, which includes a toilet bowl 3 provided on a receiving base 2, and the toilet bowl 3 includes a toilet seat and a toilet lid 4 mounted thereon, respectively. In the case of the drawings, a wash water tank 5 is provided on the top of a rear portion of the toilet bowl 3, so that a predetermined amount of wash water is flushed to wash the interior of the toilet bowl 3 by the operation of a lever after usage of the toilet bowl. Reference numeral 6 in the drawings designates a discharge pipe for soil water containing human wastes after having washed the interior of the toilet bowl 3, and is connected to a clarification treatment apparatus 10, described later, installed on a back side or the like of the toilet bowl 3. The structure in the interior of the toilet bowl 3 or a flushing mechanism of the wash water are basically the same as a water washing type toilet bowl or the flushing mechanism in the related art, and hence detailed description is omitted here.

Reference numeral 10 in the drawings designates the clarification treatment apparatus provided, for example, on the back side of the toilet bowl main body portion 1 for decomposing the soil water containing the human wastes having washed in the interior of the toilet bowl 3 separately from the toilet bowl main body portion 1.

The clarification treatment apparatus 10 includes a reaction treatment tower 30, having a structure described later, configured to clarify the soil water by performing a biological treatment by a microorganism and provided on a tank body 11 having a soil water storage tank 12 configured to temporarily store the soil water discharged from the toilet bowl 3 through the soil water discharge pipe 6 and a water storage tank 13 configured to store water obtained by performing the clarification treatment on the soil water.

Figure 4:
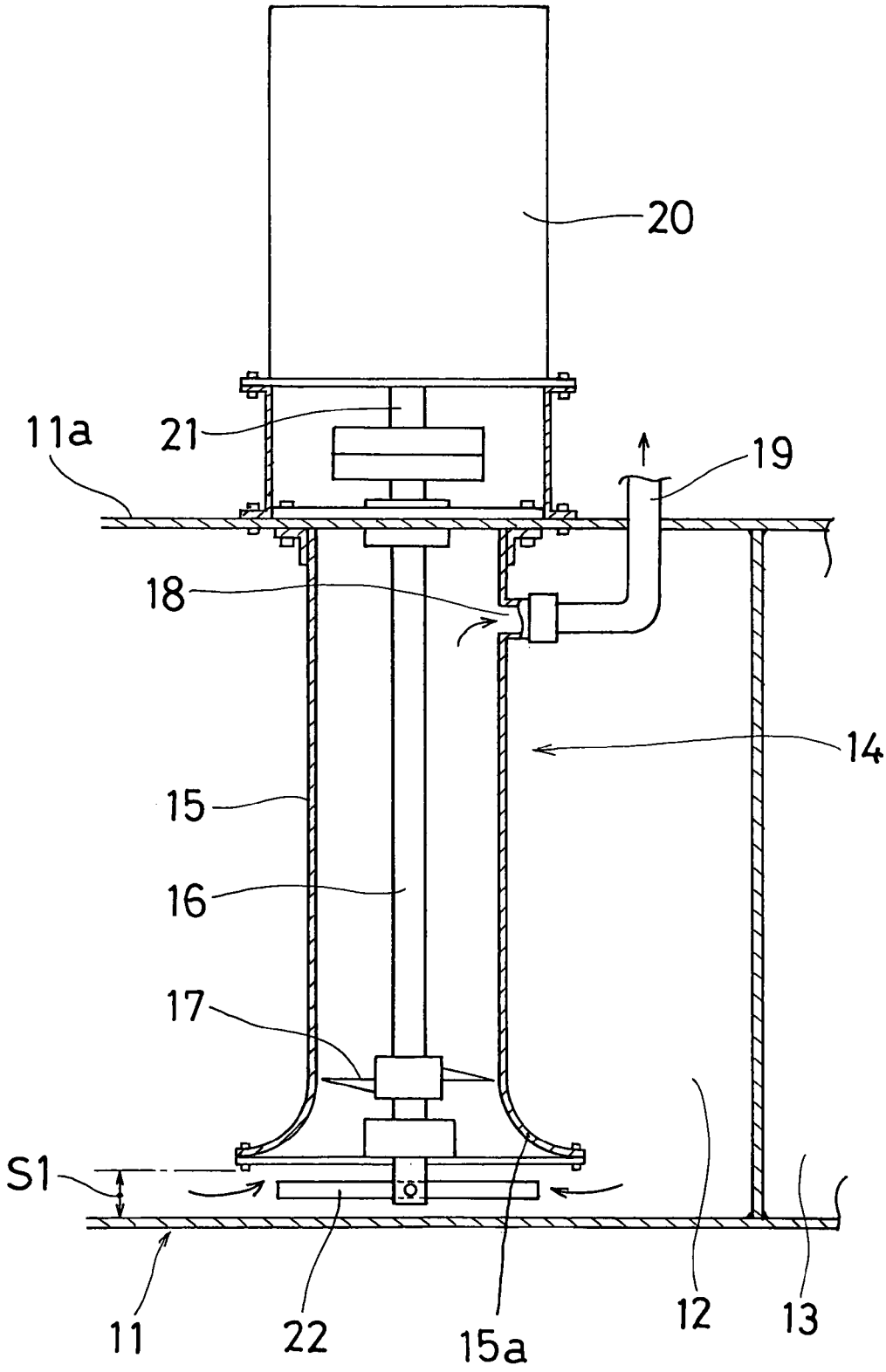
FIG. 4 is a cross-sectional view showing a portion of a first pump for soil water.

The soil water storage tank 12 includes a first pump 14 for the soil water configured to pump up and deliver the soil water stored in the soil water storage tank 12. In the embodiment shown in the drawings, the first pump 14 includes a cylindrical casing 15 being fixed to a ceiling portion of the soil water storage tank 12, extending vertically downward to a position near a bottom portion of the soil water storage tank 12 and having a suction port opened at a lower end thereof, a rotating shaft 16 arranged in the cylindrical casing 15 in the direction of a center axis thereof, and a helical blade 17 for sucking provided at a lower side of the rotating shaft 16 in the cylindrical casing 15 as shown in FIG. 4 in an enlarged scale, although a commercially available submerged pump is also applicable. A discharge port 18 is provided on a portion of the cylindrical casing 15 above the helical blade 17, a soil water feed pipe 19 is connected to the discharge port 18, so that the soil water sucked by the operation of the first pump 14 is delivered to the reaction treatment tower 30 via the soil water feed pipe 19.

A drive unit 20 of the first pump 14 is provided on the upper panel portion 11*a* of the tank body 11 above the ceiling of the soil water storage tank 12. The drive unit 20 is a motor having an axial center in the vertical direction, and the rotating shaft 16 is connected to an output shaft 21 of the motor, so that the rotating shaft 16 is rotated by the operation of the drive unit 20 and the first pump 14 is activated thereby. The drive unit 20 of the first pump 14 is controlled to be activated normally when the quantity of the soil water in the soil water storage tank 12 reaches or exceeds a certain quantity, more specifically, a certain quantity set with reference to a quantity of wash water flushed by one flushing action to drive the first pump 14, and to be stopped when the quantity of the soil water in the soil water storage tank 12 is reduced to a quantity smaller than a certain quantity. Although it is possible to provide the first pump 14 to be driven for a certain period of time in conjunction with the flushing action after the elimination, it is preferable to control the same according to the quantity of the soil water in the soil water storage tank.

The cylindrical casing 15 of the first pump 14 has a shape having a widened lower opening 15*a*, which serves as a suction port, being increased in diameter outward, so that the soil water in the soil water storage tank 12 is easily sucked. A distance S1 between an opening edge of the lower opening 15*a* and the bottom portion of the soil water storage tank 12 is set to be narrow to an extent which does not hinder the action of the pump to suck the soil water because the smaller the distance S1 is, the smaller the remaining amount of soil water in the soil water storage tank 12 becomes. For example, the distance S1 is set a distance on the order of 10 to 50 mm, more preferably, to a distance on the order of 10 to 30 mm. Also, the bottom portion of the soil water storage tank 12 may be inclined from the soil water incoming side toward a portion opposing the lower opening 15*a* for allowing the soil water to be collected near the lower opening 15*a* of the cylindrical casing 15 instead of being formed into a horizontal surface as in the drawings.

A stirring member 22 as a stirring device configured to crush the solid component in the soil water in the vicinity of the lower opening 15*a* as the suction port is mounted on the pump 14 at a lower end portion of the rotating shaft 16. The stirring member 22 rotates simultaneously with the sucking action started by the activation of the pump 14 to make a stirring action, whereby the solid content in the soil water which is sucked into the cylindrical casing 15 of the first pump 14 is efficiently crushed.

Reference numeral 23 in the drawings designates a screen for removing foreign substances such as a net member configured to partition the interior of the soil water storage tank 12 into an incoming side from the discharge pipe 6 and a sucking side sucked by the first pump 14 for preventing entry of the solid foreign substance in the soil water into the sucking side. The screen 23 is preferably demountably mounted on the soil water storage tank 12, so as to allow removal and cleaning of the foreign substances adhered on the screen 23 as needed. Although the screen may be omitted as a matter of course, it is preferable to provide the screen 23 in terms of prevention of damage of the pump due to the entry of the foreign substances.

Figure 5:
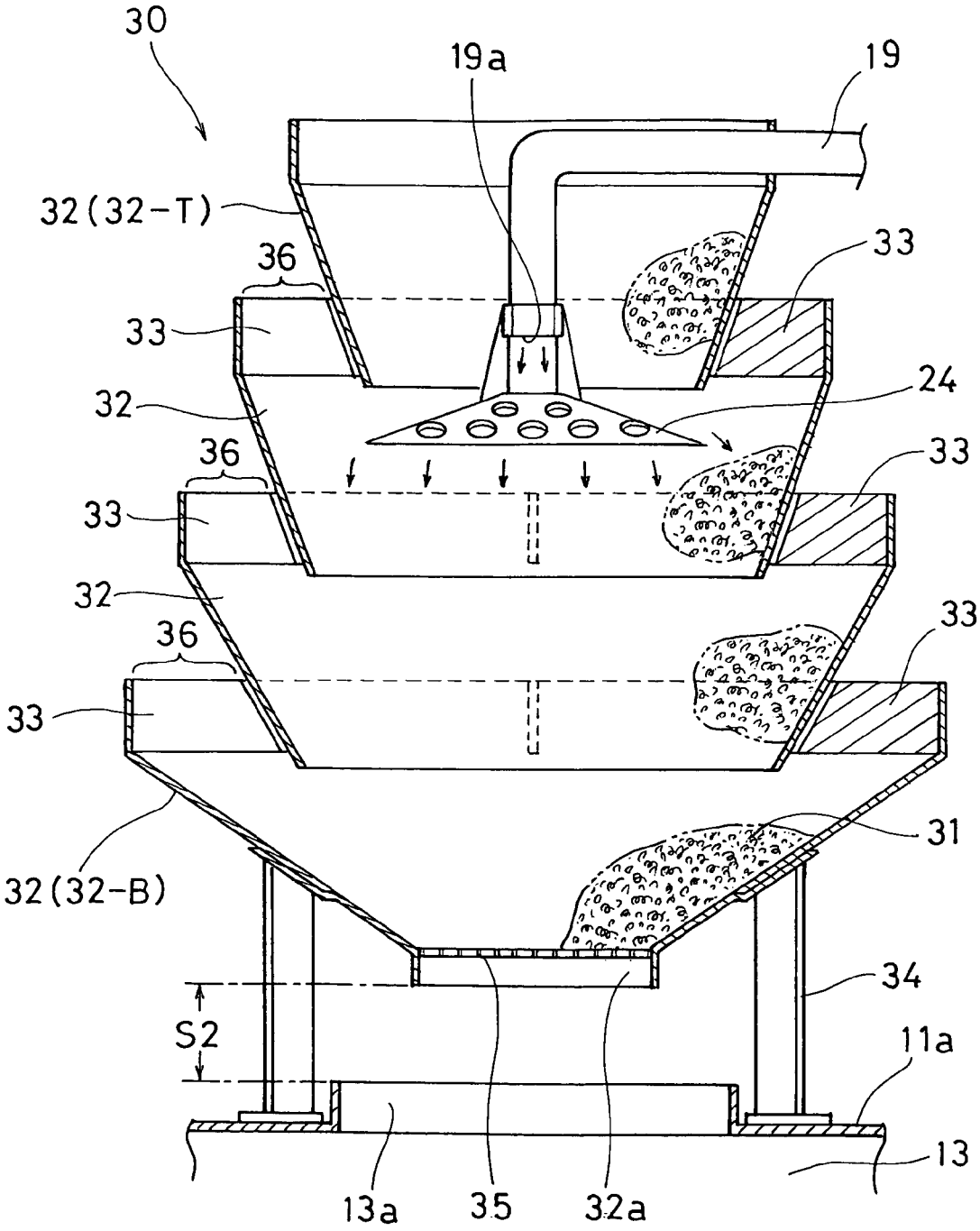
FIG. 5 is a cross-sectional view of the portion of the reaction treatment tower.

The reaction treatment tower 30 includes filter elements 31 as a microorganism carrier filled and stored in the interior thereof as shown in FIG. 5 in an enlarged scale, so that the organic matter is decomposed by the metabolic action or the biological treatment of the microorganism by the dispersion of the soil water delivered from the soil water storage tank 12 via the soil water feed pipe 19 by the first pump 14 onto the filter elements 31 in the interior thereof. The reaction treatment tower 30 includes, as shown in the drawings, a plurality of guide cylinders 32 formed into a funnel shape of a truncated cone with a large-diameter side oriented upward and combined by being stacked one on top of another so as to place a lower end portion having a small diameter of the upper guide cylinder 32 into an upper opening of the lower guide cylinder 32 at a distance from each other, and a peripheral edge portion of the upper opening of the lower guide cylinder 32 is opened upward around an outer periphery of the upper guide cylinder 32. Reference numeral 36 designates an opened portion between the upper and lower guide cylinders 32, 32.

The soil water feed pipe 19 extending upward outside the reaction treatment tower 30, being drawn into the topmost guide cylinder 32-T of the reaction treatment tower 30, and then being bent downward is opened at an end. A port end portion 19*a* of the water feed pipe 19 facing downward is provided with a dispersing member 24 formed of a perforated panel into a conical shape having a gentle inclination as a water dispersing apparatus for the soil water discharged from the port end portion 19*a*, so that the soil water discharged from the port end portion 19*a* is dispersed by the dispersing member 24 substantially uniformly over the entire area in the tower.

The guide cylinders 32 are combined by being stacked one on top of another and connected via radially extending joint panels 33 provided at fitting portions with a distance which corresponds to the opening portion 36 kept from each other. Also, a supporting leg 34 connected to a bottommost guide cylinder 32-B extends upright on the upper panel portion 11*a* of the tank body 11 and is supported to maintain a required distance S2 so as to allow outside air to enter the tower from a lower end opening 32*a* of the bottommost guide cylinder 32-B and flow upward.

In the case of the first embodiment, the respective guide cylinders 32 of the reaction treatment tower 30 are configured in such a manner that the diameter of the opening on the upper opening side of the bottommost guide cylinder 32-B is largest and is reduced gradually as it goes upward, so that that of the topmost guide cylinder 32-T is smallest. The guide cylinders 32 of the reaction treatment tower 30 are formed of a rustproof metallic material such as stainless or other rigid materials.

The filter elements 31 as the microorganism carrier to be filled in the respective guide cylinders 32 of the reaction treatment tower 30 may be various materials which achieve filtering action by carrying the microorganism such as aerobic microorganism while securing adequate liquid permeability or air permeability. However, non-uniform shaped natural wood chips such as chips of natural wood such as cedar and, more specifically, curled natural wood chips such as whittling of a plane are preferably employed. Among others, the cedar chips are preferable. A bottom member 35 having air permeability and liquid permeability such as a perforated panel such as a punching metal or a net is provided at the lower end opening 32*a* of the bottommost guide cylinder 32-B of the reaction treatment tower 30 so as to hold the filter elements 31 in the tower. It is also possible to provide the bottom members as described above at the lower openings of the respective upper guide cylinders 32 and fill and store the filter elements 31 in the respective guide cylinders 32.

An opening 13*a* of the water storage tank 13 is provided under the reaction treatment tower 30 on the upper panel portion 11*a* of the tank body 11, so that the treated water filtered and passed through the reaction treatment tower 30 and dropped from the lower end opening 32*a* enters the water storage tank 13. Therefore, the diameter of the opening 13*a* is larger than the diameter of the lower end opening 32*a* of the reaction treatment tower 30. A cylindrical vertically extending edge is provided at the lower end opening 32*a* of the reaction treatment tower 30 for dripping water to ensure dropping of the treated water passed through the reaction treatment tower 30 within a range of the lower end opening 32*a*.

Figure 6:
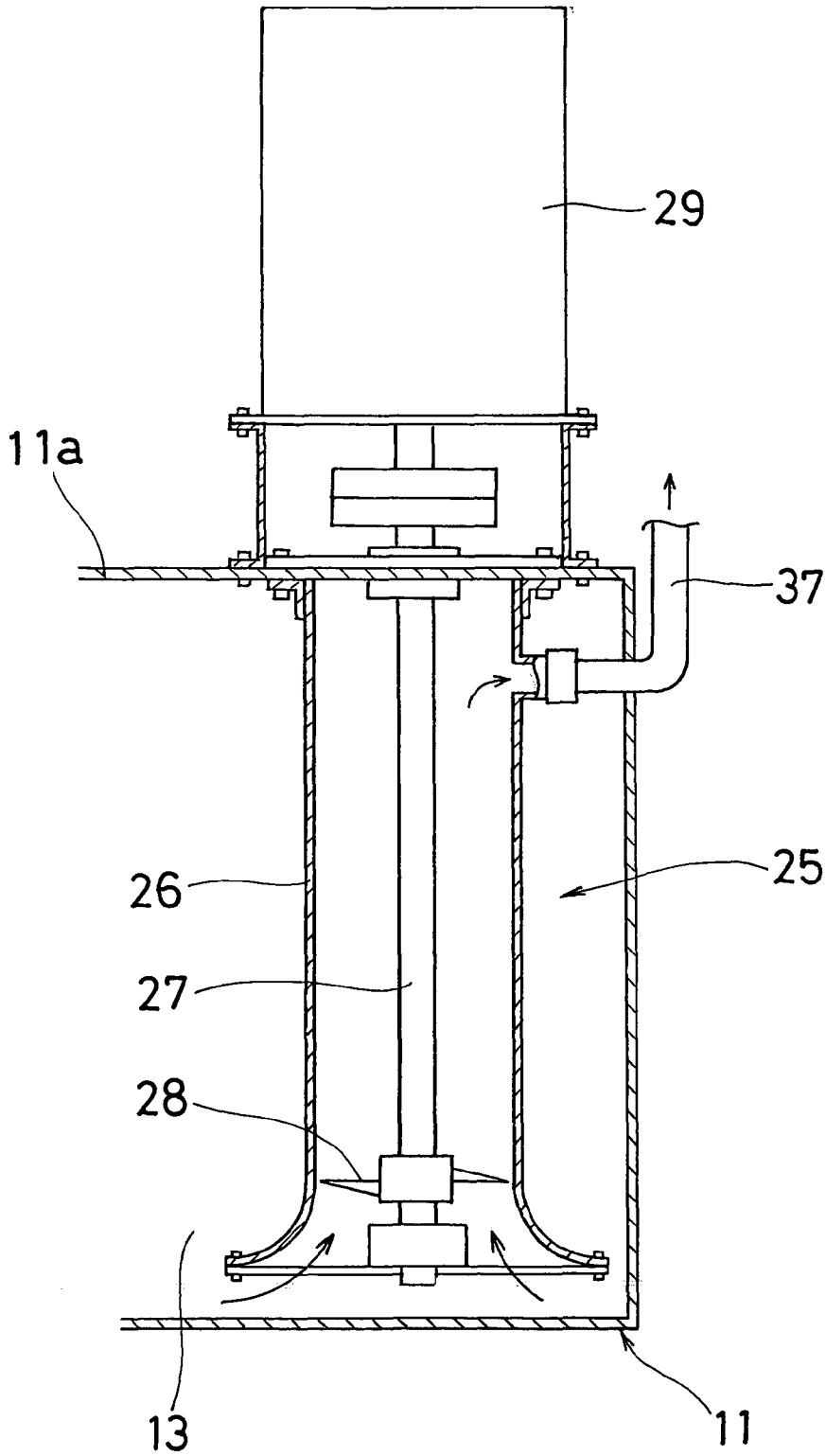
FIG. 6 is a cross-sectional view showing a portion of a second pump for wash water.
Figure 7:
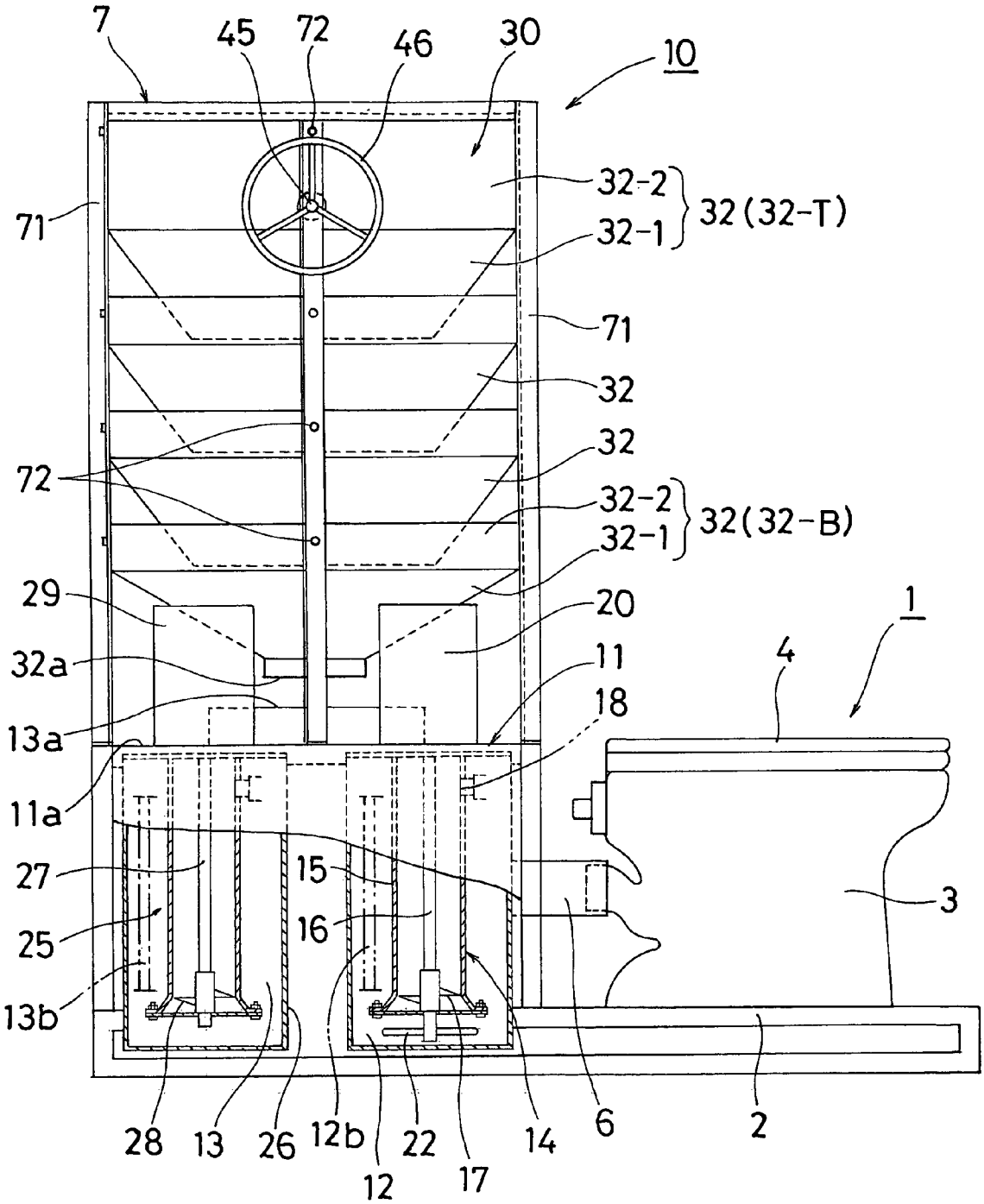
FIG. 7 is a schematic side view showing a circulating water washing system toilet according to a second embodiment of the invention partly in cross-section.
Figure 8:
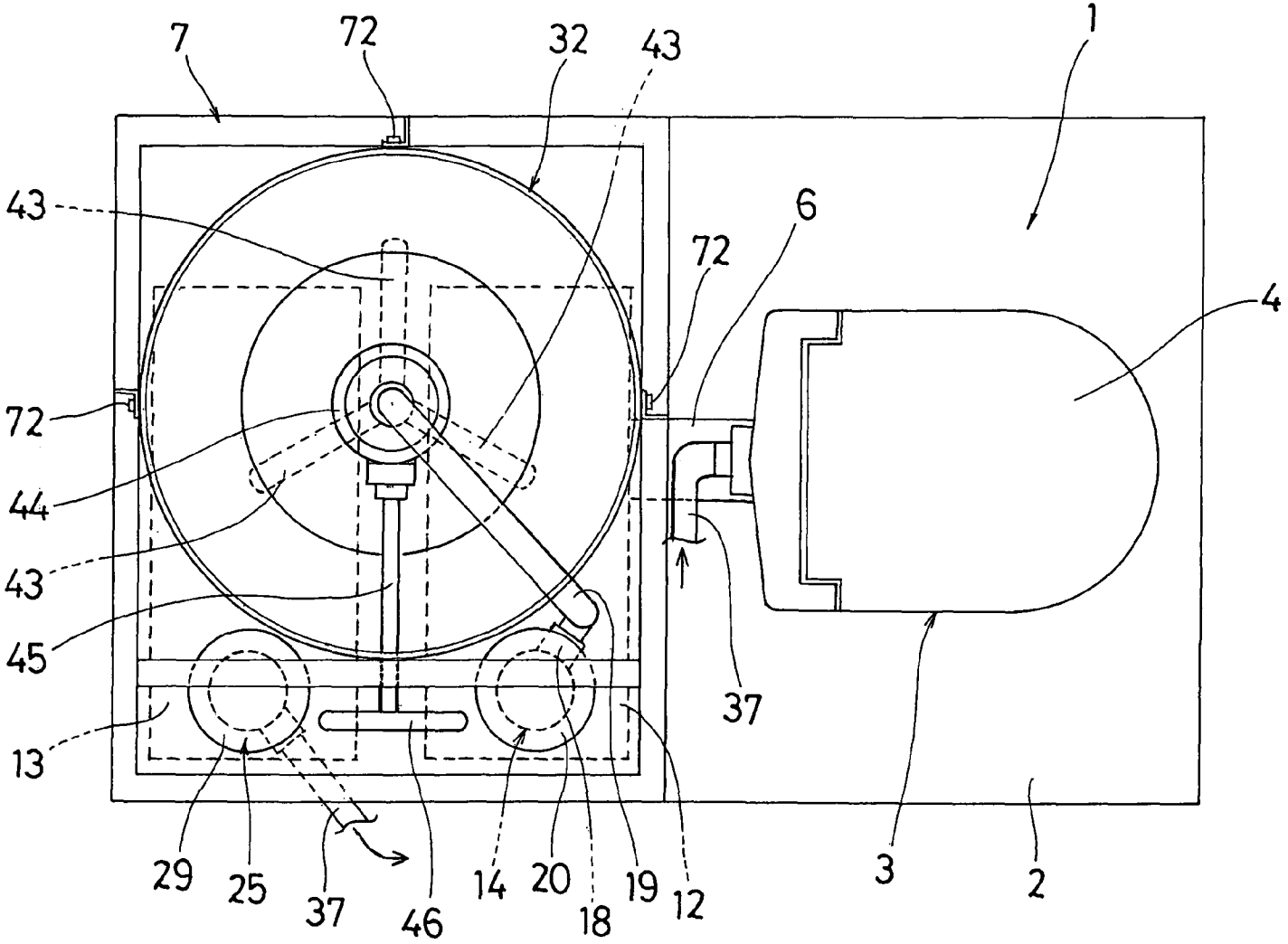
FIG. 8 is a schematic plan view of the toilet in FIG. 7.
Figure 9:
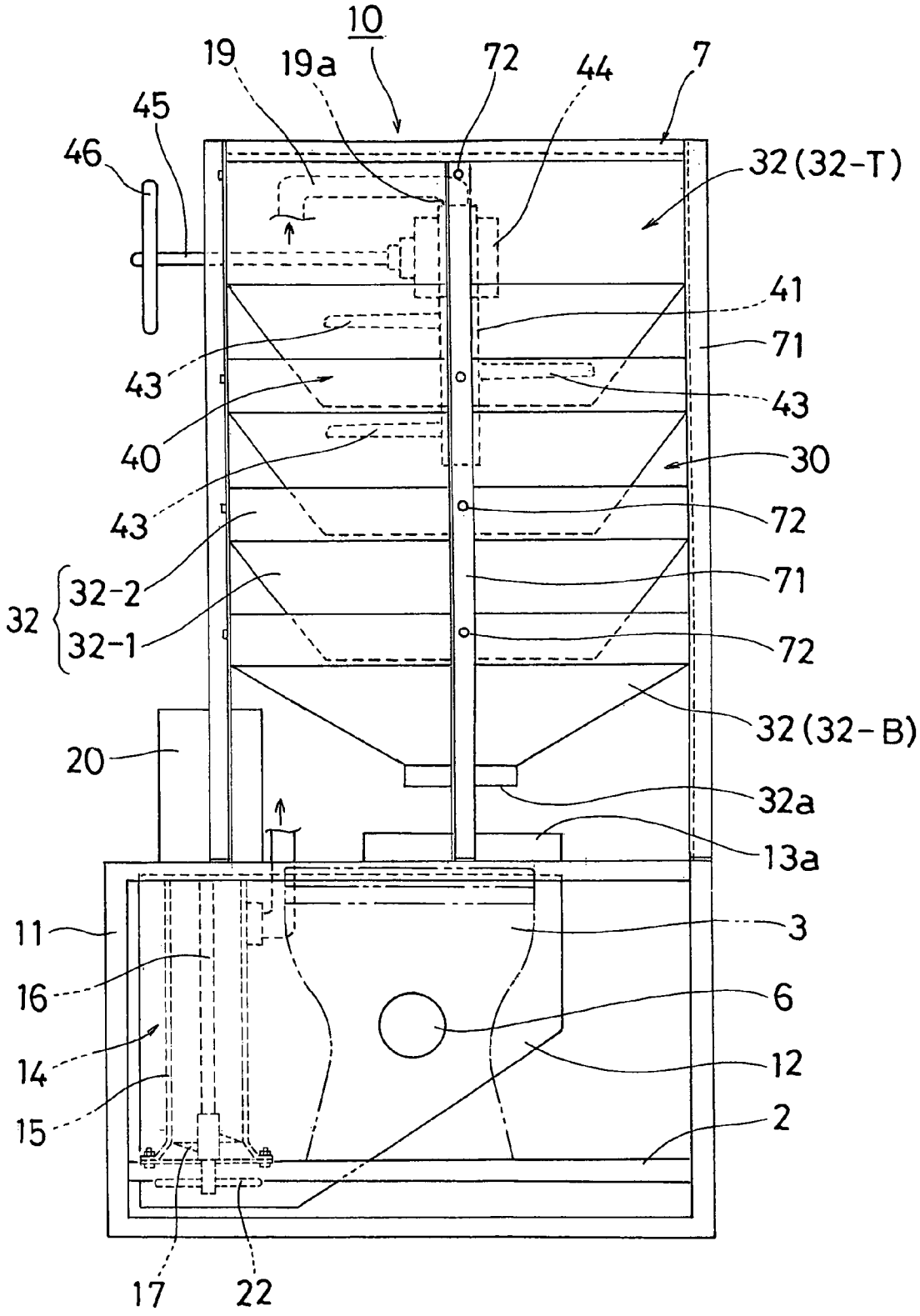
FIG. 9 is a front view of the toilet in FIG. 7 from which a toilet bowl main body portion is omitted.
Figure 10:
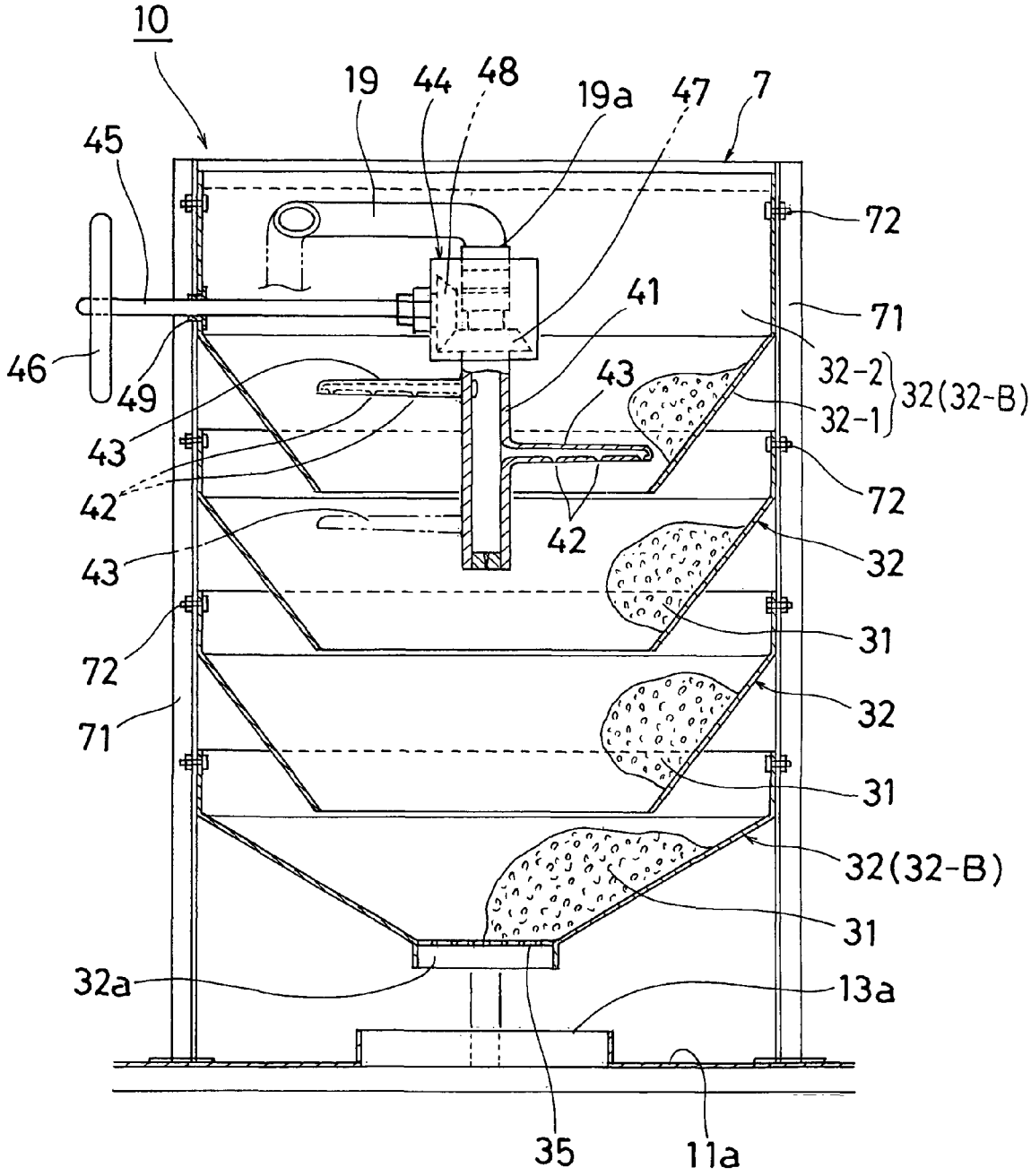
FIG. 10 is a cross-sectional view showing a portion of the reaction treatment tower of the toilet in FIG. 7.
Figure 11:
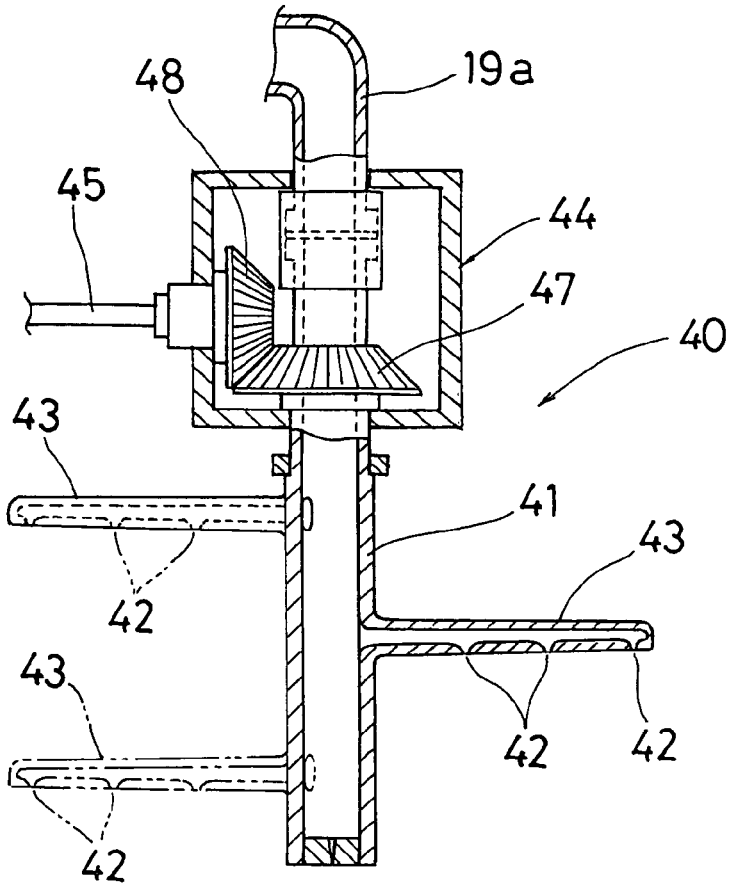
FIG. 11 is an enlarged cross-sectional view of a portion of a water dispersing apparatus of the toilet in FIG. 7.
Figure 12:
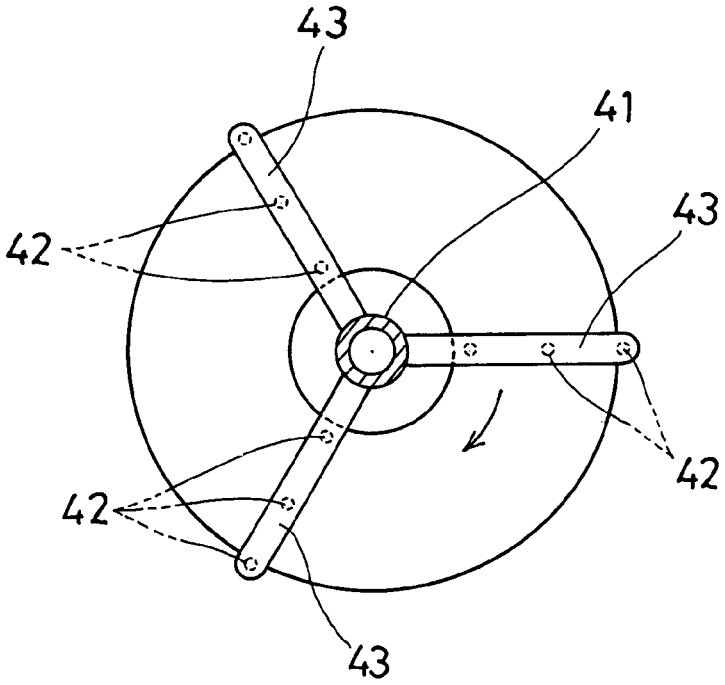
FIG. 12 is a schematic lateral cross-sectional plan view taken at a portion of a water dispersing pipe member of the toilet in FIG. 7.

The water storage tank 13 is provided with a second pump 25 configured to deliver the treated water in the water storage tank 13 as the wash water. The second pump 25 for the wash water basically has the same configuration as the first pump 14 of the soil water storage tank 12, as shown in FIG. 6, and includes a cylindrical casing 26 mounted on the upper panel portion 11*a* of the tank body 11 so as to extend vertically downward, a rotating shaft 27 arranged at an axial center in the cylindrical casing 26, a sucking helical blade 28 attached to a lower portion of the rotating shaft 27 in the cylindrical casing 26, and a motor as a drive unit 29 installed on the upper panel portion 11*a* and connected to the rotating shaft 27. In addition, a wash water feed pipe 37 connected to a delivery port formed on the top of the cylindrical casing 26 is connected to the wash water tank 5 of the toilet bowl body portion 1, so that the treated water in the water storage tank 13 is pumped up and delivered to the wash water tank 5 by the rotation of the rotating shaft 27 of the pump 25 caused by the activation of the drive unit 29.

The drive unit 29 is controlled to drive the pump 25 by being activated every time when the flushing action to flush wash water in the wash water tank 5 is preformed or by being activated automatically when the water quantity in the wash water tank 5 is reduced to a predetermined level or lower. Also, when the wash water tank is not provided on the toilet bowl body portion 1, a configuration in which the water in the water storage tank 13 is delivered to the toilet bowl 3 by the second pump 25 for flushing the toilet bowl is also applicable. However, it is preferable to provide the wash water tank 5 for the practical use.

Although not shown in the drawings, a portion of the reaction treatment tower 30 of the clarification treatment apparatus 10, more preferably, the entire portion of the clarification treatment apparatus 10 is covered by an enclosure for hiding such as a panel member having air permeability such as a perforated plate or a sheet having air permeability, so as to keep out of view from the outside.

The circulating water washing system toilet according to the first embodiment as described above is used by installing on a floor at a desired position when used in the room for person in need of nursing care for example, and, alternatively, the toilet bowl body portion 1 and the clarification treatment apparatus 10 may preferably installed on a base 39 with casters 38 as shown in FIG. 1 to allow easy movement. Accordingly, the movement to a desired position in the room is easily achieved.

When using the toilet, water of a quantity required for circulating the wash water is stored in the wash water tank 5 of the toilet bowl body portion 1 and the water storage tank 13 of the clarification treatment apparatus 10 in advance. At the time of usage, the soil water containing the human wastes having used for washing the toilet bowl 3 after the elimination flows into the soil water storage tank 12 and stored once. At this time, the foreign substances mixed into the soil water are removed by the provision of the screen 23 for removing the foreign substances. When the soil water in the soil water storage tank 12 reaches or exceeds a certain quantity, the first pump 14 for the soil water is activated to pump up the solid component in the soil water from the lower opening 15*a* of the cylindrical casing 15 while crushing the same by the stirring member 22, delivers the same to the upper portion of the reaction treatment tower 30 via the water feed pipe 19, and disperses the same over the filter elements 31 as the microorganism carrier in the reaction treatment tower 30.

The dispersed soiled water flows downward gradually along the filter elements 31 and, in the course of flowing downward, the solid component thereof is trapped by the filter elements 31 and the water component thereof passes through the filter elements 31 while coming into contact therewith and running therethrough while making the evaporation reaction. While this passage, the biological treatment is performed, and the water content having subjected to the biological treatment enters the water storage tank 13 provided below the reaction treatment tower 30. In contrast, the solid component remaining adhesively on the filter elements 31 is decomposed by the metabolic action or the biological treatment of the microorganism carried in the filter elements 31 and disappears. For example, according to an experiment, all the organic matter disappeared in 5 to 8 hours although depending on the peripheral temperature.

In particular, since the reaction treatment tower 30 includes the plurality of guide cylinders 32 formed into a funnel shape combined by being stacked one on top of another at a distance from each other, and satisfactory air permeability is provided by the opening portion 36 between the respective guide cylinders 32, 32 around the outer peripheries thereof to ensure easy evaporation of the water content, the evaporation reaction is satisfactorily performed. The microorganism which decompose the organic matter in the soil water by the evaporation reaction is classified into fungus which acts actively in a humid environment, and fungus which only acts in a humidity of 20 to 30%. As a result of the experiment, since the structure of the reaction treatment tower 30 having the stacked funnel shaped guide cylinders provided areas with high water content and areas for allowing the water content to evaporate, it was found that the structure of the reaction treatment tower 30 was optimum for the decomposition treatment.

The treated water stored in the water storage tank 13 after having filtered as described above is delivered as the wash water by the activation of the pump 25 as needed and, for example, is delivered to and stored in the wash water tank 5 of the toilet bowl body portion 1 and is reused as the wash water after the elimination.

Since the water content is evaporated in the treatment in the reaction treatment tower 30, it is necessary to add water as needed even though the water content is added by the excrement containing urine to some extent. However, the quantity of water to be added may be a small content, and the quantity of water to be used is smaller than the normal flush toilet.

FIG. 7 to FIG. 12 show a second embodiment of the invention. The basic configuration of the toilet in the second embodiment is the same as the first embodiment described above, and the same configurations and the same components are designated by the same reference numerals and detailed description is omitted. Subsequently, an outline of a configuration of the second embodiment different from the first embodiment will principally be described.

In the case of the second embodiment, the tank for the wash water is not provided on the back side of the toilet bowl 3 of the toilet bowl body portion 1, but is configured in such a manner that the water in the water storage tank 13 of the clarification treatment apparatus 10 is delivered by the operation of a lever after the usage of the toilet bowl by the pumping device, or the water delivered from the tank separately provided is flushed as will be described later. As a matter of course, the second embodiment may be implemented by providing the wash water tank as in the embodiment described above.

In the clarification treatment apparatus 10, although the soil water storage tank 12 and the water storage tank 13 provided in the interior of the tank body 11 are different in arrangement and form from the first embodiment, they have the same roles as those in the first embodiment, and have the substantially same configurations as in the first embodiment respectively. In other words, the soil water storage tank 12 stores the soil water flushed from the toilet bowl 3 once, and includes the first pump 14 configured to pump up the stored soil water and deliver the same to the upper portion of the reaction treatment tower 30 via the soil water feed pipe 19. Also, the water storage tank 13 is configured to store the treated water treated in the reaction treatment tower 30, and the water storage tank 13 is provided with the second pump 25 configured to pump up the stored water and deliver the same via the wash water feed pipe 37. Since the detailed configurations of the first pump 14 and the second pump 25 are the same as those described in the first embodiment, the respective components are designated by the same reference numerals, and detailed description will be omitted here. The soil water storage tank 12 and the water storage tank 13 are provided with liquid level meters 12*b*, 13*b* respectively for sensing a liquid level.

The reaction treatment tower 30 provided on the top of the tank body 11 is basically the same as that in the first embodiment. However, in the second embodiment, a supporting frame 7 is provided upright on the tank body 11, and the reaction treatment tower 30 is installed inside the supporting frame 7.

The reaction treatment tower 30 includes the plurality of guide cylinders 32 in which the filter elements 31 as the microorganism carrier filled and stored in the interior thereof combined by being stacked one on top of another. However, in the second embodiment, the guide cylinders 32 each include a lower cylindrical portion 32-1 having a truncated cone with the large-diameter side oriented upward and an upper cylindrical portion 32-2 extending upward from an upper end of the lower cylindrical portion 32-1, and the guide cylinders 32 are combined by being stacked one on top of another with a distance which forms the opening portion 36 by placing the lower end portions of the lower cylindrical portions 32-1 of the guide cylinders 32 in the respective levels in the upper openings of the underlying guide cylinders 32.

The diameter of the upper cylindrical portions 32-2 of the guide cylinders 32 in the respective levels are the same, and the upper cylindrical portions 32-2 are secured to supporting posts 71 formed of section bars or the like which constitute the supporting frame 7 standing upright on the tank body 11 detachably with tightening members 72 such as bolts and nuts or undetachably by welding (not shown) at a plurality of points in the circumferential direction, for example, four points at the front, back, left, and right as shown in the drawings.

Therefore, a configuration which corresponds to the radially extending joint panels 33 as in the first embodiment is not necessary between the upper and lower guide cylinders 32. The configuration in which the bottom member 35 such as the punching metal for holding the filter elements 31 is provided at the lower end opening 32*a* of the bottommost guide cylinder 32 (32-B) and the treated water dropped from the lower end opening 32*a* is guided to the water storage tank 13 is the same as the first embodiment. The similar bottom members may be provided at the lower openings of the respective guide cylinders 32.

In the second embodiment, the soil water feed pipe 19 extending upward on the outside of the reaction treatment tower 30 is drawn into the uppermost guide cylinder 32 (32-T) from the side, and the water dispersing apparatus configured to disperse the soil water onto the filter elements 31, for example, a water dispersing apparatus 40 configured as follows is provided at the port end portion 19*a* formed at an end a portion of the water feed pipe 19 bent vertically downward.

The water dispersing apparatus 40 in the second embodiment is configured in such a manner that a water dispersing pipe member 41 is connected to the port end portion 19*a* of the water feed pipe 19 so as to be rotatable about the center of the port end portion 19*a*, and the pipe member 41 is provided with nozzle members 43 projecting radially outward from different positions thereof in terms of the circumferential direction thereof at required angular pitches and at a distance from each other in the direction of the axial center, and each having one or a plurality of nozzle ports 42 on a lower surface thereof at a distance from each other in the direction of extension thereof. Accordingly, the soil water delivered from the soil water storage tank 12 through the water feed pipe 19 is discharged from the respective nozzle ports 42 of the respective nozzle member 43 to disperse the same on the filter elements 31 in the guide cylinders 32. Although a lower end portion of the pipe member 41 is closed, the lower end portion may be provided with the nozzle ports.

The water dispersing pipe member 41 of the water dispersing apparatus 40 is connected to a handle 46 provided outside of the reaction treatment tower 30 via a rotation transmitting portion 44 and a handle shaft 45, so that the positions of the nozzle members 43 may be changed as needed by rotating the pipe member 41 by the rotating operation of the handle 46.

The rotation transmitting portion 44 may be of various rotation transmitting mechanisms such that a bevel gear 48 on the handle shaft 45 is engaged with a bevel gear 47 on the pipe member 41 so that the rotating operation of the handle 46 transmits the rotation to the bevel gear 48 via the handle shaft 45 to cause the pipe member 41 to rotate via the bevel gear 47 which is engaged to the bevel gear 48. For example, a worm gear mechanism may be employed instead of the bevel gears.

The angle of rotation of the water dispersing pipe member 41 may be set as desired by the rotating operation of the handle 46, whereby the positions of projections of the nozzle members 43 provided so as to project from the pipe member 41 are changeable and adjustable as desired, so that the soil water discharged from the nozzle ports 42 are dispersed entirely over the filter elements 31.

For example, as in the drawings, when the three nozzle members 43 are arranged at pitches of 120° in the circumferential direction of the water dispersing pipe member 41, by rotating the pipe member 41 by ¼ turn (rotation by) 90°) or a half turn (rotation by 180°) with the handle 46 at every water dispersion action after the usage of the toilet, the positions of the nozzle members 43 may be changed at pitches of 30° or 60° in the circumferential direction, so that the entire dispersion over the filter elements 31 is achieved as described above, and the entire filter elements is utilized effectively for the filtering action substantially evenly.

In other words, assuming that the positions of the nozzle members 43 of the water dispersing apparatus 40 are fixed, the soil water is dispersed repeatedly at the same positions, so that water channels which allow the soil water to pass through are formed in the filter elements and hence the entire filter element layer cannot be effectively used for the filtering action. However, by changing the positions of the nozzle members 43 sequentially as described above, the entire filter element layer is effectively used.

The handle shaft 45 is rotatably supported by the supporting frame 7 via a bearing member 49. The port end portion 19*a* of the feed pipe 19, which is oriented downward, is applied with loads from the pipe member 41, the nozzle members 43, and the rotation transmitting portion 44 of the water dispersing apparatus 40. Therefore, it is preferable to provide a supporting member (not shown) for supporting the feed pipe 19.

In the second embodiment as well, the portion of the reaction treatment tower 30 of the clarification treatment apparatus 10, more preferably, the entire portion of the clarification treatment apparatus 10 is covered by an enclosure for hiding so as to keep out of view from the outside while securing the air permeability required for the reaction treatment, although not shown in the drawing.

The circulating water washing system toilet according to the second embodiment may be used in the room for the person in need of nursing care, for example, as in the case of the first embodiment. In this case, it may be used by being installed on the base with the casters, although not shown in the drawings, in addition to the usage by installing on the floor at a desired position.

In usage of the toilet, the soil water containing the human wastes having used for washing the toilet bowl 3 after the elimination flows into the soil water storage tank 12 and stored once. At this time, the foreign substances mixed into the soil water may be removed by the provision of the screen for removing the foreign substances. When the soil water in the soil water storage tank 12 reaches or exceeds a certain quantity, the soil water is delivered to the upper portion of the reaction treatment tower 30 via the water feed pipe 19 by the activation of the first pump 14 for the soil water, and is dispersed onto the filter elements 31 as the microorganism carrier in the reaction treatment tower 30 from the nozzle ports 42 of the respective nozzle members 43 of the water dispersing apparatus 40 connected to the port end portion 19*a* of the water feed pipe 19.

The dispersed soiled water flows downward gradually along the filter elements 31 and, in the meanwhile, the solid component thereof is trapped by the filter elements 31, and the water component thereof passes through the filter elements while coming into contact therewith and running therethrough while making the evaporation reaction. While this passage, the biological treatment is performed, and the water content having subjected to the biological treatment enters the water storage tank 13 provided below the reaction treatment tower 30. In contrast, the solid component remaining adhesively on the filter elements 31 is decomposed by the metabolic action or the biological treatment of the microorganism carried in the filter elements 31 and disappears.

Then, the handle 46 is rotated at every water dispersing action to rotate the water dispersing pipe member 41 and the positions of the nozzle members 43 extending from the pipe member 41 are changed. Accordingly, the portion where the dispersed soil water running along the filter elements 31 does not flow locally, so that the entire part of the filter element layer is effectively used for the filtering described above.

The treated water stored in the water storage tank 13 after having filtered as described above is delivered as the wash water by the activation of the second pump 25 and is reused as the wash water after the elimination. In this usage, the water content is evaporated, and hence the water is added as needed. However, the quantity of addition of water may be a small quantity.

The treated water stored in the water storage tank 13 is turned into brown due to the material used for the filter element 31 such as the wood chips, for example, the lixivium of the chips. However, removal of lixivium may be performed as needed.

The water dispersing apparatus in the toilet in the second embodiment, specifically the water dispersing apparatus 40 configured to allow the positional adjustment of the nozzle members 43 by the rotational operation of the handle 46 may be used for the dispersion of the soil water in the reaction treatment tower 30 in the first embodiment, and the same advantages as described above are obtained.

The both cases of the toilet in the first embodiment and the toilet in the second embodiment may be configured to be able to treat a large volume for a case of being used by a number of persons by using an anaerobiotic tank and an aerobic tank in parallel depending on the mode of usage such as the place to be used.

As described above, according to the toilet in the invention, the human wastes having washed the toilet bowl is decomposed and treated gradually, and the clarified water is stored in the water storage tank as the wash water which can be reused, so that the soil water before treatment remains little in the soil water storage tank and, in addition, is treated every time of usage, so that generation of the unpleasant odor is prevented, and the usage without a sense of discomfort in terms of hygiene is achieved. Since the water content is evaporated due to the evaporation reaction in the reaction treatment tower, an effect to moisturize the room is also expected.

The invention is applied not only as the toilet that injured persons or aged persons in need of nursing care are used in the room in nursing facilities or families, but also as the toilet being installed in the event sites or outdoors.

What is claimed is:

1. A circulating water washing system toilet configured to clarify soil water containing human wastes after having washed a toilet bowl and reuse the same as wash water, comprising: a clarification treatment apparatus configured to decompose the soil water discharged from the toilet bowl independently from a toilet bowl main body portion, the clarification treatment apparatus including a soil water storage tank configured to temporarily store the soil water, a first pump configured to pump up and deliver the soil water in the soil water storage tank, a reaction treatment tower having filter elements as a microorganism carrier configured to perform a biological treatment while dispersing the soil water delivered by the first pump on the filter elements and filtering the same, a water storage tank configured to receive and store water passing through the reaction treatment tower, and a second pump configured to pump up and deliver the water in the water storage tank as the wash water.

2. The circulating water washing system toilet according to claim 1, wherein the reaction treatment tower includes a plurality of guide cylinders formed into a funnel shape of a truncated cone with a large-diameter side oriented upward and combined by being stacked one on top of another so as to place a lower opening on a small-diameter side of the upper guide cylinder inside an upper opening on the large-diameter side of the lower guide cylinder at a distance from each other, and the filter elements comprise natural wood chips as the microorganism carrier, the natural wood chips being contained in the interior of the reaction treatment tower in the interior thereof.

3. The circulating water washing system toilet according to claim 2, wherein a water delivery pipe from the first pump is drawn into an interior of the guide cylinder on an topmost layer, and a water dispersing apparatus is provided at a port end portion of the water delivery pipe for dispersing the delivered soil water onto the filter elements.

4. The circulating water washing system toilet according to claim 3, wherein the water dispersing apparatus includes a water dispersing pipe member rotatably connected to the port end portion of the downwardly bent water delivery pipe, the water dispersing pipe member including nozzle members projecting radially outward from different positions thereof with respect to the circumferential direction thereof, the nozzle member having a nozzle port on a lower surface thereof, the water dispersing pipe member being connected to a handle for a rotating operation provided out of the tower via a rotation transmitter, and the directions of projection of the nozzle members are changeable by the rotating operation of the handle.

5. The circulating water washing system toilet according to claim 1, wherein the system is configured so that the first pump is activated when the quantity of the soil water in the soil water storage tank reaches and exceeds a certain quantity and pumps up and delivers the soil water.

6. The circulating water washing system toilet according to claim 1, wherein the first pump includes a stirring device configured to break a solid component in the soil water in the vicinity of a suction port.

7. The circulating water washing system toilet according to claim 5, wherein the first pump includes the stirring device configured to break the solid component in the soil water in the vicinity of the suction port.

8. The circulating water washing system toilet according to claim 1, wherein the soil water storage tank includes a screen configured to remove foreign substances arranged on the incoming side of the soil water from the toilet bowl.

9. The circulating water washing system toilet according to claim 5, wherein the soil water storage tank includes the screen configured to remove the foreign substances arranged on the incoming side of the soil water from the toilet bowl.

10. The circulating water washing system toilet according to claim 6, wherein the soil water storage tank includes the screen configured to remove the foreign substances arranged on the incoming side of the soil water from the toilet bowl.

11. The circulating water washing system toilet according to claim 1, wherein the first pump includes a cylindrical casing provided in the soil water storage tank so as to extend vertically downward from a ceiling portion of the soil water storage tank to a position in the vicinity of a bottom portion thereof and opened at a lower end thereof as the suction port, a rotating shaft connected rotatably by a drive unit installed in the cylindrical casing at the ceiling portion, a helical blade for pumping-up operation provided on the rotating shaft on the lower side in the cylindrical casing, and a soil water delivery pipe connected to a discharge port formed at part of the cylindrical casing on the upper side and configured to allow delivery of water to the reaction treatment tower.

12. The circulating water washing system toilet according to claim 11, wherein the stirring member configured to crush the solid component sucked from the lower end opening of the cylindrical casing is provided at a lower end portion of the rotating shaft of the first pump.

13. The circulating water washing system toilet according to claim 12, wherein the soil water storage tank includes the screen configured to remove the foreign substances arranged on the incoming side of the soil water from the toilet bowl.

14. The circulating water washing system toilet according to claim 1, wherein the toilet bowl main body portion and the clarification treatment apparatus are installed on a base with casters so as to be movable.

15. The circulating water washing system toilet according to claim 11, wherein the toilet bowl main body portion and the clarification treatment apparatus are installed on the base with the casters so as to be movable.

* * * * *

UNITED STATES PATENT AND TRADEMARK OFFICE

CERTIFICATE OF CORRECTION

PATENT NO. : 8,110,097 B2
APPLICATION NO. : 12/456609
DATED : February 7, 2012
INVENTOR(S) : Masashi Arai It is certified that error appears in the above-identified patent and that said Letters Patent is hereby corrected as shown below:

On the Title Page:

Please correct the name of the Assignee from:

Item (73) Assignee: "Toya Kogyo Kabushiki Kaisha" Suita-shi (JP)

to

Item (73) Assignee: "Toyo Kogyo Kabushiki Kaisha" Suita-shi (JP)

Signed and Sealed this
First Day of May, 2012

David J. Kappos

David J. Kappos
*Director of the United States Patent and Trademark Office*